US007224340B2

(12) United States Patent
Pai et al.

(10) Patent No.: US 7,224,340 B2
(45) Date of Patent: May 29, 2007

(54) METHOD OF PROCESSING SIGNAL OF LCM TIMING CONTROLLER

(75) Inventors: Feng-Ting Pai, Hsinchu (TW); Chuan-Ying Wang, Kaohsiung Hsien (TW); Chih-Wei Wang, Hsinchu (TW)

(73) Assignee: Hannstar Display Corp., Taipei (TW)

( * ) Notice: Subject to any disclaimer, the term of this patent is extended or adjusted under 35 U.S.C. 154(b) by 183 days.

(21) Appl. No.: 09/862,484

(22) Filed: May 23, 2001

(65) Prior Publication Data

US 2002/0003523 A1 Jan. 10, 2002

(30) Foreign Application Priority Data

Jul. 4, 2000 (TW) ..... 89113199

(51) Int. Cl.
*G09G 3/36* (2006.01)

(52) U.S. Cl. ..... 345/99; 345/212; 345/213

(58) Field of Classification Search ..... 345/87, 345/204, 55, 50, 92, 98–99, 212–213
See application file for complete search history.

(56) References Cited

U.S. PATENT DOCUMENTS

| | | | | |
|---|---|---|---|---|
| 4,325,063 | A * | 4/1982 | Herman | 345/551 |
| 4,500,815 | A * | 2/1985 | Johnston, Jr. | 315/366 |
| 4,665,551 | A * | 5/1987 | Sternberg et al. | 382/257 |
| 4,679,065 | A * | 7/1987 | Umezawa | 348/657 |
| 5,856,818 | A | 1/1999 | Oh et al. | |
| 6,177,922 | B1 * | 1/2001 | Schiefer et al. | 345/698 |
| 6,181,317 | B1 * | 1/2001 | Taguchi et al. | 345/698 |
| 6,288,713 | B1 * | 9/2001 | Lee et al. | 345/204 |

* cited by examiner

*Primary Examiner*—Richard Hjerpe
*Assistant Examiner*—Leonid Shapiro
(74) *Attorney, Agent, or Firm*—Birch, Stewart, Kolasch & Birch, LLP

(57) ABSTRACT

A method of processing signals of a timing controller of a liquid crystal display module, wherein the signals are processed according to a rising edge or a falling edge of a synchronizing signal to generate the control signals for the liquid crystal display module, the control signals including start vertical signals STV (including STV1 and STV2) and gate-on enable signals OE. Then, the gate clock signal CPV, STV1, STV2, and OE pause to be outputted.

4 Claims, 8 Drawing Sheets

METHOD OF PROCESSING SIGNAL OF LCM TIMING CONTROLLER

BACKGROUND OF THE INVENTION

1. Field of the Invention

The present invention relates in general to a method of processing signals. In particular, the present invention relates to a method of processing signals of an LCM (LCD Module, Liquid Crystal Display Module) timing controller.

2. Description of the Related Art

According to U.S. Pat. No. 5,856,818, as shown in FIG. 1, an LCM 10 has a timing controller 12 which generates signals, such as a gate clock signal CPV, start vertical signals STV1, STV2, or a gate-on enable signal OE for a gate driver 16 and a source driver 18 of a LCD panel 14 after receiving a horizontal synchronizing signal HSYNC, a vertical synchronizing signal VSYNC, and a data enable signal DE.

In another mode, as shown in FIG. 2, the timing controller 12 which generates signals, such as a gate clock signal CPV, start vertical signals STV1, STV2, or a gate-on enable signal OE for a gate driver 16 and a source driver 18 of a LCD panel 14 after receiving a data enable signal DE.

In the method of processing signals of a conventional timing controller, as shown in FIG. 3 or FIG. 4, a next control signal is generated according to a memory value of a previous horizontal or vertical cycle. When an LCD module is in DE mode or in the mode of three synchronizing signals HSYNC, VSYNC, DE, a conventional timing controller decodes control signals according to the memory values of horizontal and vertical cycles. For example, in a vertical blank period VB (v-blank) of the data enable signal DE, the start vertical signals STV1, STV2 are generated according to the gate clock signal CPV.

Refer to FIG. 5 and FIG. 6 which correspond to the methods of processing signals in FIG. 3 and FIG. 4 respectively. The timing controller processes signals according to the memory values of horizontal and vertical cycles, such as the vertical blank period VB (v-blank), the gate clock signal CPV. Since signals of the horizontal and vertical cycles are unstable, the horizontal or vertical cycle of a video signal is caused to vary. As far as the timing controller is concerned, the cycle variance incurs erroneous operations of control signals. For example, the gate clock signal CPV does not generate the start vertical signals STV1, STV2 until after the vertical blank period VB(v-blank) of the data enable signal DE, and the display frame of the LCD module is therefore caused to jitter or bounce. The start vertical signals STV include: a first start vertical signal STV1, for determining a start scan location of a frame; and a second start vertical signal STV2, for offsetting the flicker and display brightness.

SUMMARY OF THE INVENTION

Accordingly, an object of the present invention provides a solution to the problem caused by a conventional timing controller which processes signals according to a memory value of a previous horizontal or vertical cycle. The present invention provides a real time process, instead of the process of using a cycle memory value, so as to process control signals in real time, thereby acquiring a correct control waveform which drives the LCD module.

The real time process for control signals can overcome the timing controller's erroneous operations caused by cycle variance. Basically, in DE mode, instead of the horizontal and vertical cycle values, the vertical synchronizing signal generated from decoding the DE signal is used as a reference basis. Signals are processed at the rising edge or the falling edge of a vertical synchronizing signal, and the control signals of the LCD module are generated in real time. For example, after the start vertical signals STV1, STV2 and the gate-on enable signal OE are generated in real time, the CPV (gate clock signal), STV1, STV2, and OE pause to be outputted till the timing controller detects a first DE signal after the vertical blank period, and then the normal control signals restart to be outputted, so that the real time driving is achieved.

If the timing controller receives the synchronizing signals DE, HSYNC, and VSYNC from outside simultaneously, the control signals are generated according to HSYNC and VSYNC. HSYNC resets each horizontal cycle. VSYNC, same as in DE mode, generates the control signals of LCD module at the rising edge or the falling edge of VSYNC. After the control signals corresponding to a timing sequence are outputted, the control signals CPV, STV1, STV2, and OE pause to be outputted (the process is the same as in DE mode).

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

Figure 7:
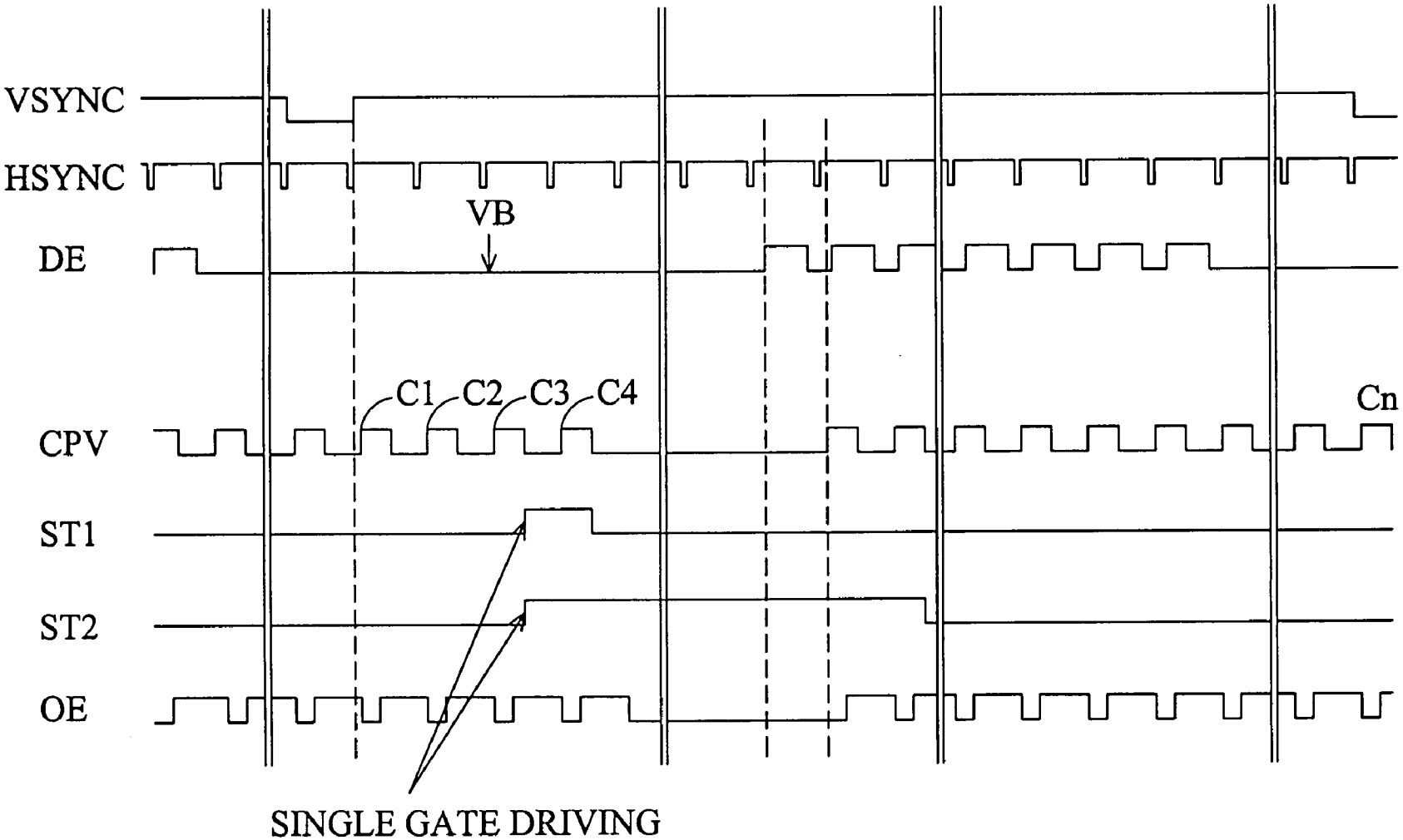
FIG. 7 shows a timing diagram of the signals of an LCD module receiving DE, HSYNC, VSYNC simultaneously in accordance with a preferred embodiment of the present invention.
Figure 8:
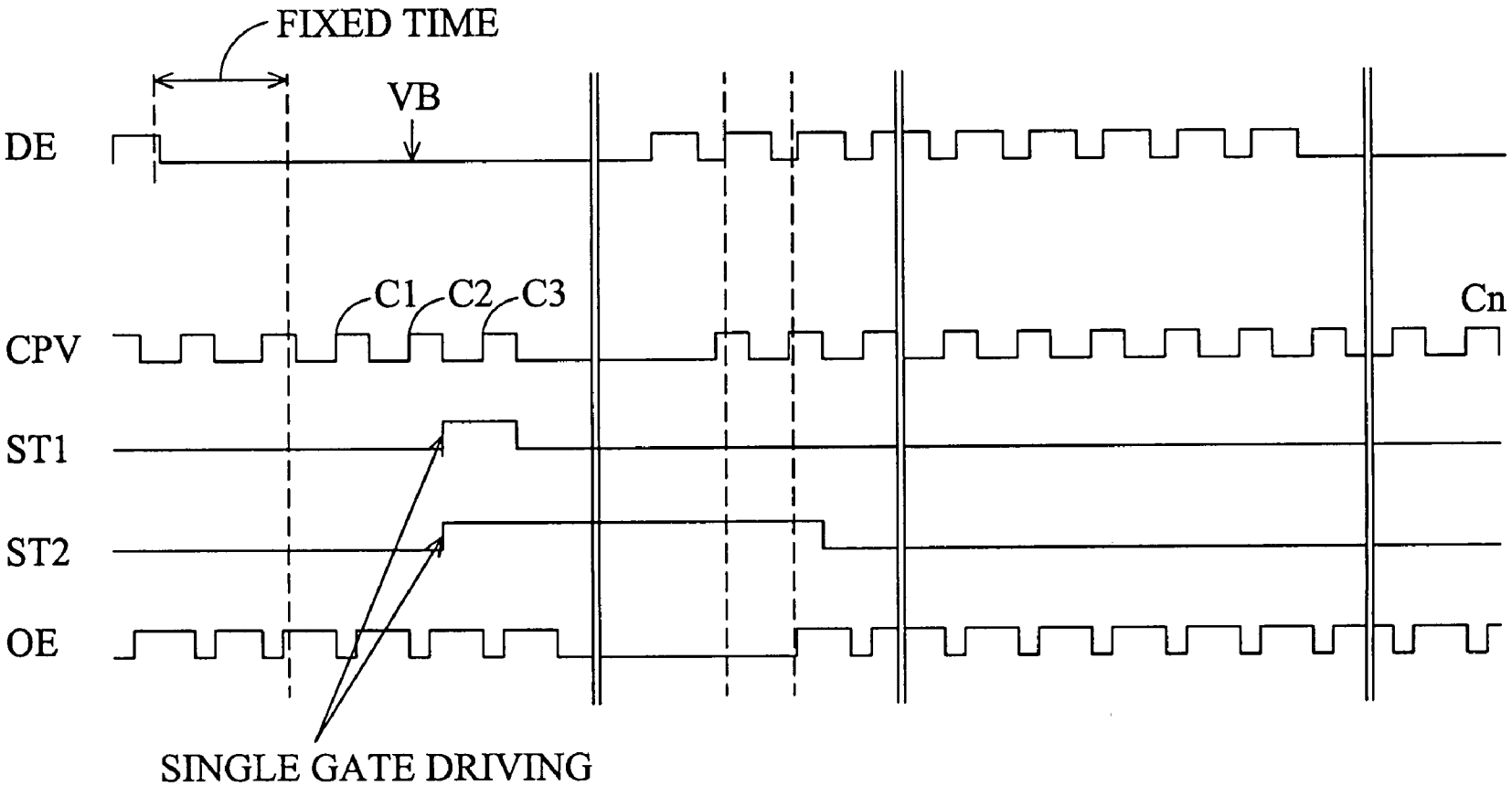
FIG. 8 shows a timing diagram of the signals of an LCD module in DE mode in accordance with a preferred embodiment of the present invention.

Refer to FIG. 7 and FIG. 8. To solve the problems caused by a conventional timing controller which processes signals according to the cycle memory values, the present invention provides a real time process, in stead of the process of using cycle memory values, so as to process control signals in real time, thereby acquiring a correct control waveform which drives the LCD module.

Figure 2:
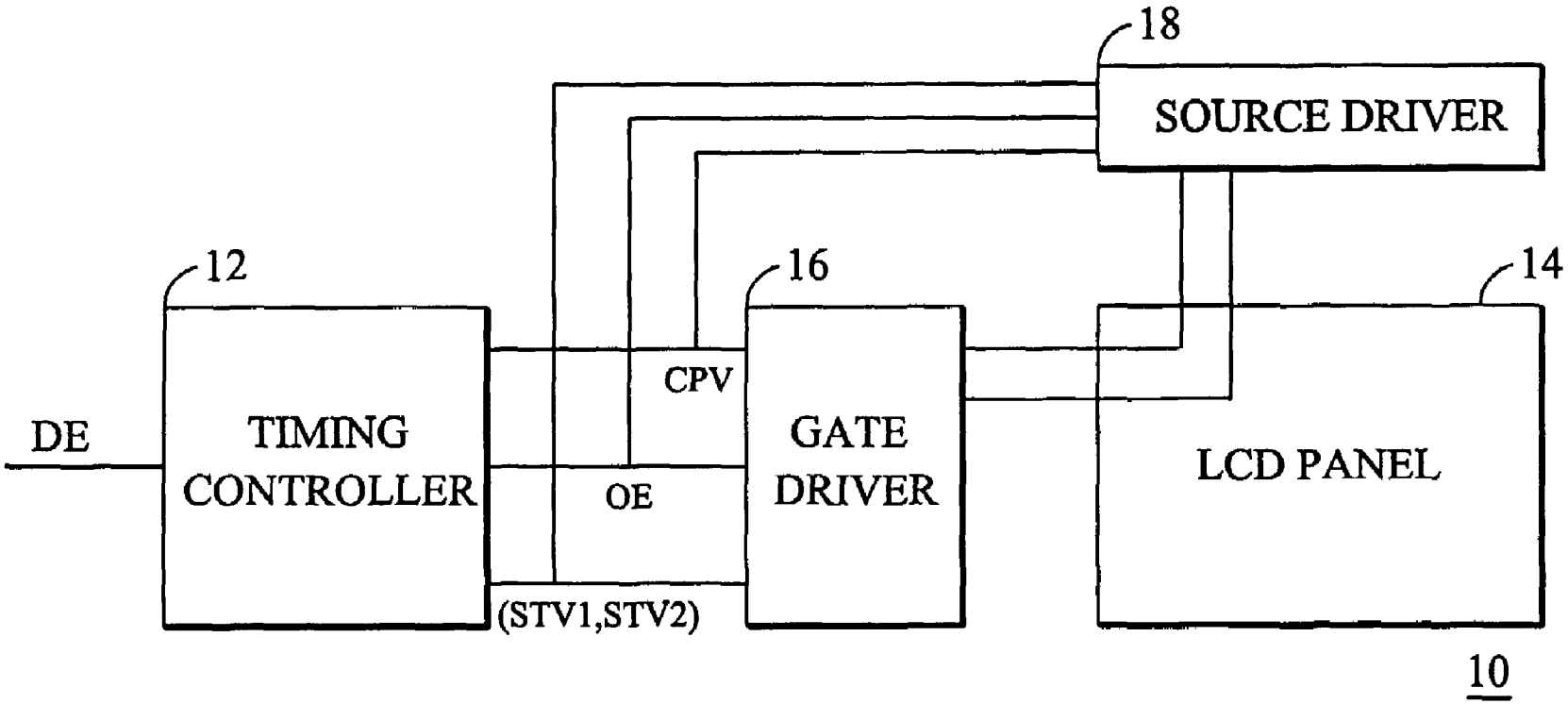
FIG. 2 ( PRIOR ART )
FIG. 2 is a schematic diagram of a LCD module in DE mode.
Figure 3:
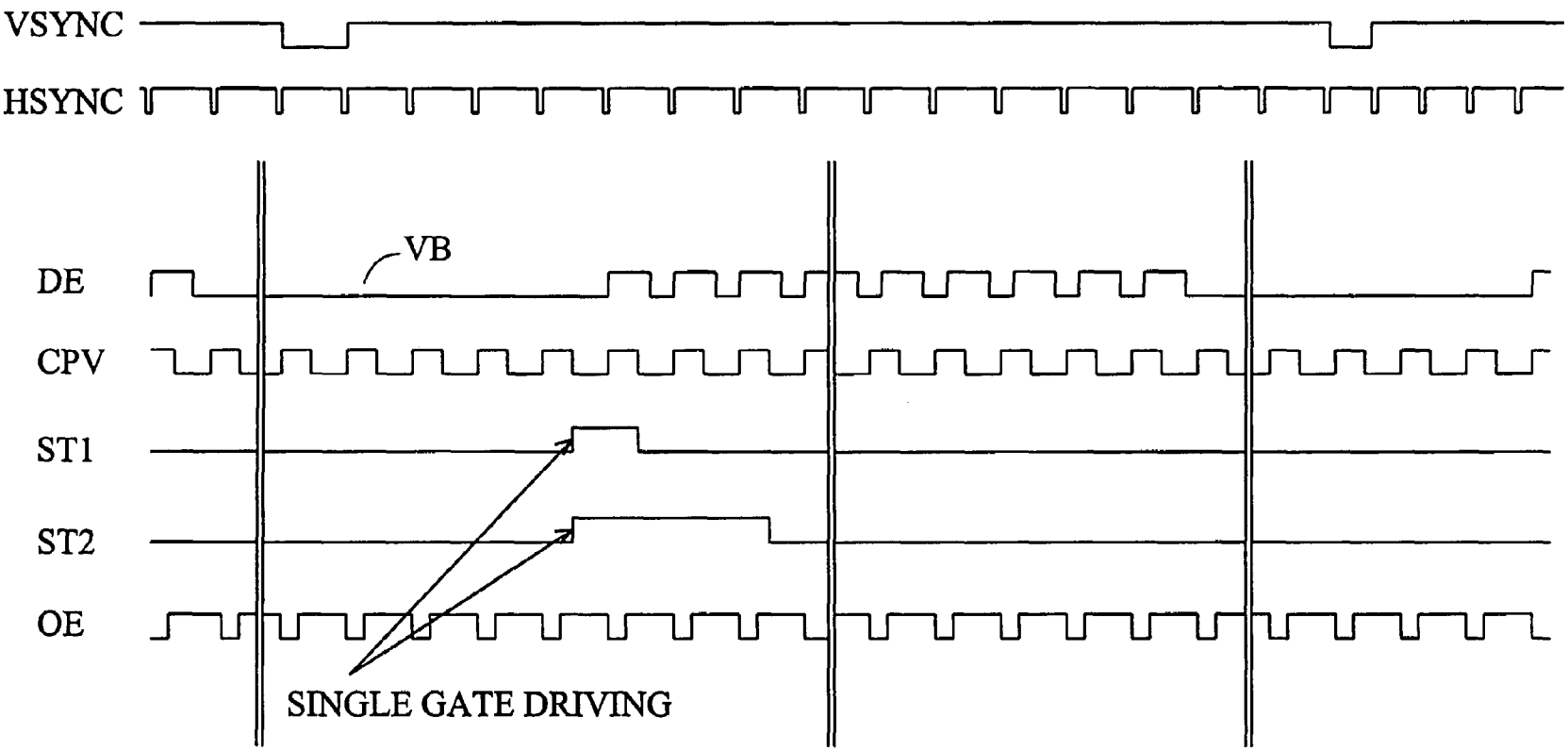
FIG. 3 ( PRIOR ART )
FIG. 3 shows a timing diagram of the signals of a conventional LCD module receiving DE, HSYNC, VSYNC simultaneously.
Figure 4:
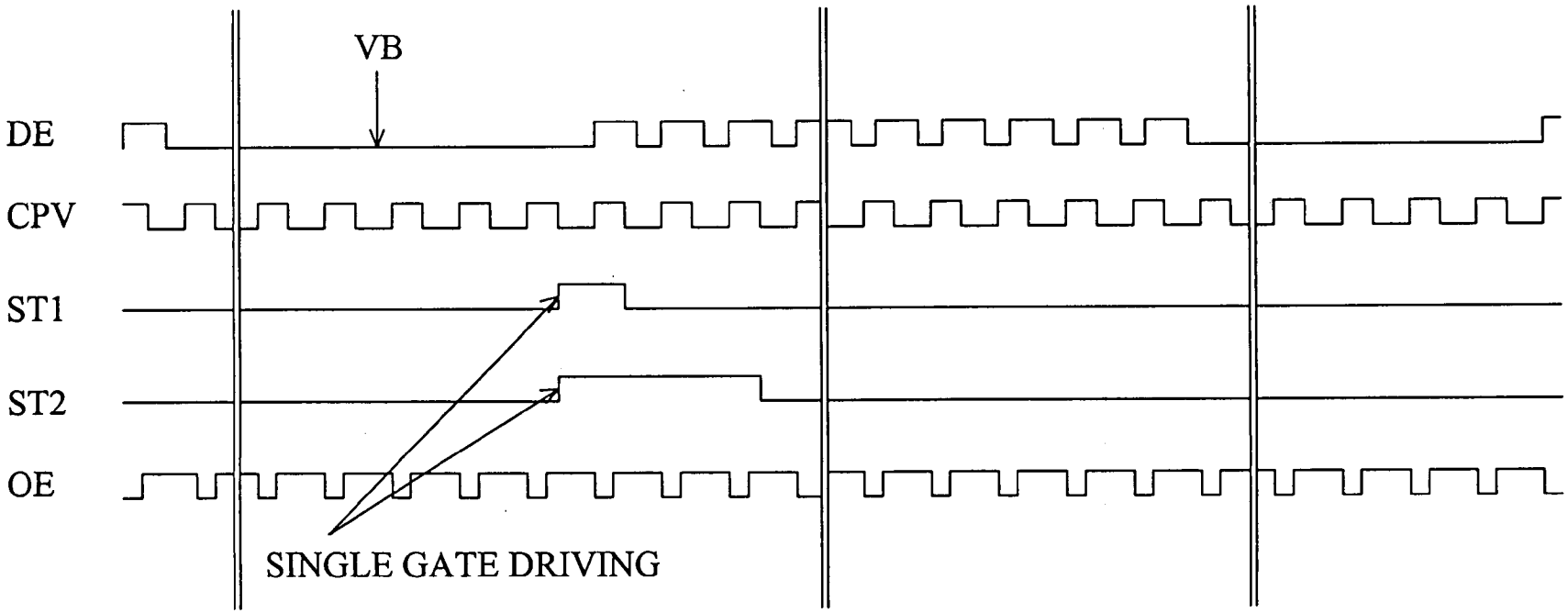
FIG. 4 ( PRIOR ART )
FIG. 4 shows a timing diagram of the signals of a conventional LCD module in DE mode.
Figure 5:
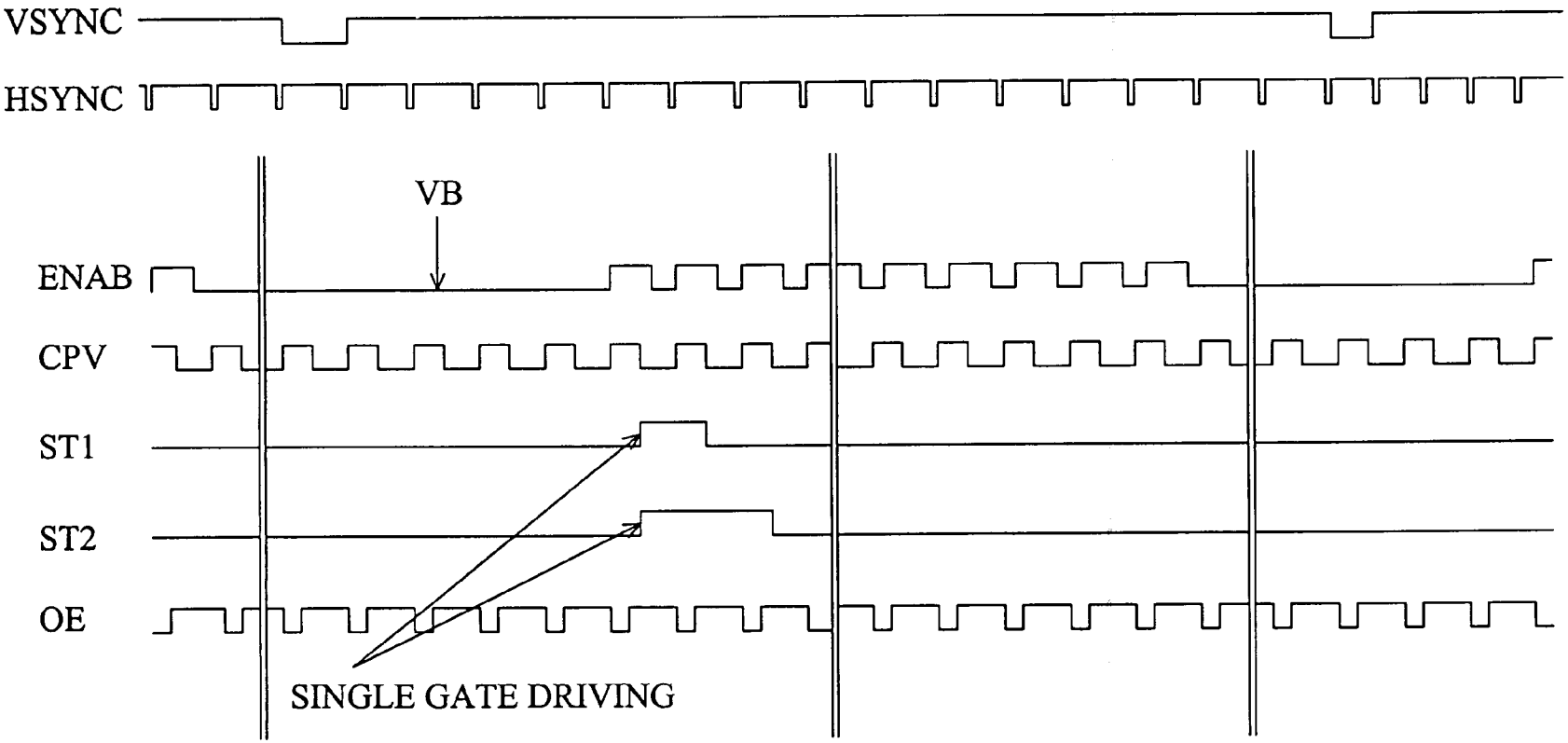
FIG. 5 ( PRIOR ART )
FIG. 5 shows a timing diagram of the signals of a conventional LCD module which, receiving DE, HSYNC, VSYNC simultaneously, does not operate properly.
Figure 6:
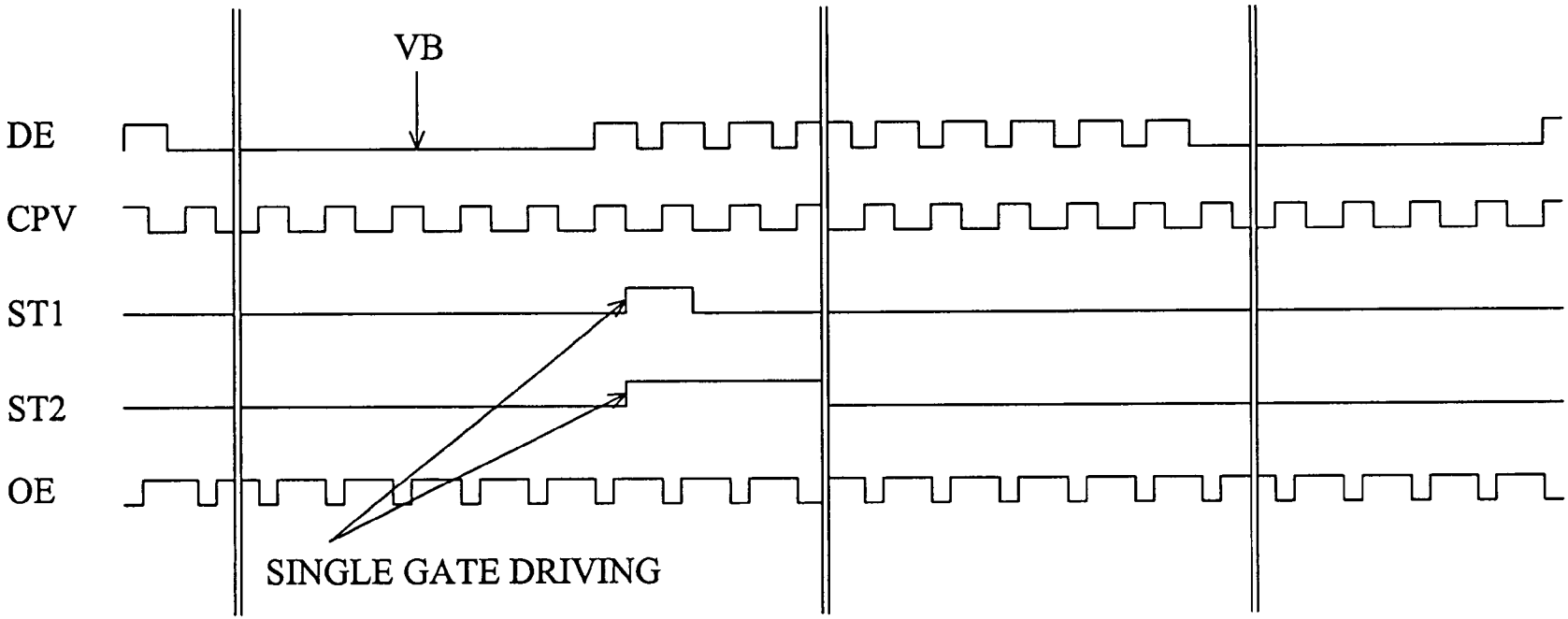
FIG. 6 ( PRIOR ART )
FIG. 6 shows a timing diagram of the signals of a conventional LCD module which does not operate properly in DE mode.

Refer to FIG. 2 and FIG. 8. In DE mode, the vertical blank period VB (v-blank) and gate clock signal CPV are used as a reference basis in the prior art. In the present invention, the vertical synchronizing signal generated from decoding the signal DE is used as a reference basis. At the rising edge or the falling edge of the vertical synchronizing signal, signals are processed to generate the control signals of the LCD module 10 in real time. For example, after the start vertical signals STV1, STV2 and the gate-on enable signal OE are generated in real time, the CPV (gate clock signal), STV1, STV2, and OE pause to be outputted till the timing controller 12 detects a first DE signal after the vertical blanking period, and then the normal control signals restart to be outputted so that the real time driving is achieved.

Figure 1:
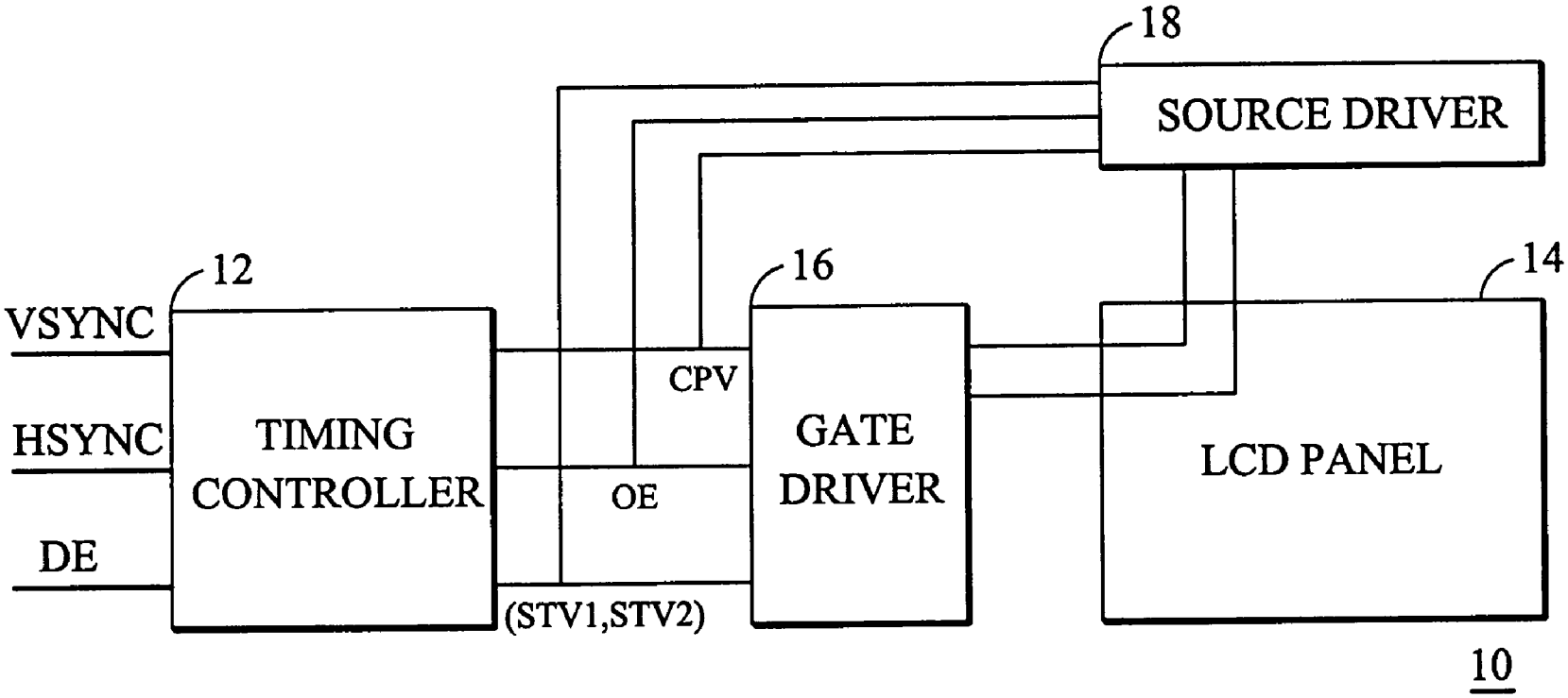
FIG. 1 ( PRIOR ART )
FIG. 1 is a schematic diagram of a LCD module which receives three synchronizing signals DE, HSYNC, VSYNC simultaneously.

Refer to FIG. 1 and FIG. 7. If the timing controller 12 receives the synchronizing signals DE, HSYNC, and VSYNC from outside simultaneously, the control signals are generated according to HSYNC and VSYNC. HSYNC resets each horizontal cycle. VSYNC, same as in DE mode, generates the control signals of LCD module 10 at the rising edge or the falling edge of VSYNC. After the control signals corresponding to a timing sequence are outputted, the control signals CPV, STV1, STV2, and OE pause to be outputted (the process is the same as in DE mode).

To solve the problem caused by a conventional timing controller which processes signals according to a vertical blank period VB (v-blank) and a gate clock signal CPV, the present invention provides a method of processing signals of a timing controller 12 of the LCD module 10, the method includes the steps of: at first, the timing controller 12 receives a data enable signal DE which has a vertical blank period VB; the timer controller 12 generates a gate clock signal CPV which has a plurality of gate clock cycles C1–Cn; then, the timing controller 12 generates a plurality of gate-on enable signals OE simultaneously according to the plurality of gate clock cycles C1–Cn of the gate clock signal CPV; then, before the end of the vertical blank period VB and after at least a gate clock cycle C1 during the vertical blank period VB, start vertical signals STV (including STV1 and STV2) are generated; and, the timing controller 12 pauses outputting CPV, STV(including STV1 and STV2), and OE till the end of the vertical blank period VB.

Finally, while the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of processing signals of a timing controller of a liquid crystal display module to achieve real time driving, comprising the steps of:

(a) receiving a vertical synchronizing signal;

(b) receiving a data enable signal DE which has a vertical blank period;

(c) generating a gate clock signal CPV which has a plurality of gate clock cycles C1–Cn;

(d) after a rising edge or a falling edge of the vertical synchronizing signal, generating a plurality of gate-on enable signals OE simultaneously according to the plurality of gate clock cycles C1–Cn of the gate clock signal CPV;

(e) after a rising edge or a falling edge of the vertical synchronizing signal, generating start vertical signals STV before the end of the vertical blank period VB and after at least a gate clock cycle C1 during the vertical blank period VB wherein the start vertical signals STV includes a first start vertical signal STV1 to determine a start scan location of a frame and a second start vertical signal STV2 to offset flicker and display brightness of the liquid display; and (f) after generating the start vertical signals STV, pausing output of CPV, STV1 and OE until the end of the vertical blank period VB, so as to process control signals in real time so that real time driving is achieved.

2. The method as claimed in claim 1, wherein in the step (c), start vertical signals STV are generated after at least a third cycle C3 during the vertical blank period VB.

3. A method of processing signals of a timing controller of a liquid crystal display module to achieve realtime driving, comprising the steps of:

(a) receiving a data enable signal DE which has a vertical blank period;

(b) decoding the data enable signal DE to generate a vertical synchronizing signal;

(c) generating a gate clock signal CPV which has a plurality of gate clock cycles C1–Cn;

(d) after a rising edge or a falling edge of the vertical synchronizing signal, generating a plurality of gate-on enable signals OE simultaneously according to the plurality of gate clock cycles C1–Cu of the gate clock signal CPV;

(e) after a rising edge or a falling edge of the vertical synchronizing signal, generating start vertical signals STV before the end of the vertical blank period VB and after at least a gate clock cycle C1 during the vertical blank period VB wherein the start vertical signals STV includes a first start vertical signal STV1 to determine a start scan location of a frame and a second start vertical signal STV2 to offset flicker and display brightness of the liquid display; and (f) after generating the start vertical signals STV, pausing output of CPV, STV1, and OE until the end of the vertical blank period VB, so as to process control signals in real time so that real time driving is achieved.

4. The method as claimed in claim 3, wherein in step (c), start vertical signals STV are generated after at least a third cycle C3 during the vertical blank period VB.

* * * * *